US005271715A

United States Patent [19]

Zelesky et al.

[11] Patent Number: 5,271,715

[45] Date of Patent: Dec. 21, 1993

[54] COOLED TURBINE BLADE

[75] Inventors: Mark F. Zelesky, Coventry, Conn.; Samuel R. Miller, Jr., Port St. Lucie, Fla.; William L. Plank, Tequesta, Fla.; Thomas A. Auxier, Lake Park, Fla.

[73] Assignee: United Technologies Corporation, Hartford, Conn.

[21] Appl. No.: 993,584

[22] Filed: Dec. 21, 1992

[51] Int. Cl.[5] ..... F01D 5/18

[52] U.S. Cl. ..... 416/97 R; 416/96 R

[58] Field of Search ..... 416/95, 96 R, 96 A, 416/97 R, 97 A; 415/115

[56] References Cited

U.S. PATENT DOCUMENTS

| | | | |
|---|---|---|---|
| 3,810,711 | 5/1974 | Emmerson et al. | 416/97 A |
| 4,257,737 | 3/1981 | Andress et al. | 416/97 R |
| 4,347,037 | 8/1982 | Corrigan | 416/97 A |
| 4,753,575 | 6/1988 | Levengood et al. | 416/97 R |

FOREIGN PATENT DOCUMENTS

| | | | |
|---|---|---|---|
| 104507 | 8/1980 | Japan | 416/97 A |
| 198305 | 10/1985 | Japan | 416/97 R |
| 251404 | 11/1987 | Japan | 416/97 R |
| 364747 | 3/1973 | U.S.S.R. | 416/96 A |

*Primary Examiner*—Edward K. Look
*Assistant Examiner*—James A. Larson
*Attorney, Agent, or Firm*—Norman Friedland

[57] ABSTRACT

An air cooled gas engine turbine blade that includes a plurality of longitudinally spaced cavities adjacent the leading edge of the blade is designed to include angularly disposed impingement passages flowing cooling air into each of the cavities in a direction extending from the root to the tip of the blade and including an annular projection upstream of the impingement passage but adjacent thereto for directing air into the respective cavities with total instead of static pressure. The impingement holes are oriented to align with the film cool holes in the blade surface at the leading edge. Ribs formed between cavities are also oriented to be parallel to the impingement holes.

3 Claims, 3 Drawing Sheets

COOLED TURBINE BLADE

The invention was made under a U.S. Government contract and the Government has rights herein.

TECHNICAL FIELD

This invention relates to air cooling of the turbine blades of a gas turbine engine and particularly to the cooling of the leading edge thereof.

BACKGROUND ART

As is well known in the gas turbine engine art, it is manifestly important to maximize the use of compressor air that is utilized outside the engine cycle. Of particular importance is the use of compressor air utilized to cool the turbine blades and to assure that the lower pressurized air is used rather than air that is at a higher pressure. Obviously, the lower the pressure of the air being used for turbine blade cooling, the lower the performance penalty and the overall improvement in engine performance. Additionally, utilizing a lower pressure improves the designer's ability to reduce leakages. And the lower pressure air is cooler and hence more effective for cooling purposes.

One aspect that contributes to the higher pressure of the compressor air is the fact that a predetermined pressure ratio across the turbine film cooled holes is necessary to obtain adequate film cooling of the exit air. By utilizing the total pressure instead of the static pressure of the cooling air for feeding the impingement cavities and increasing the outflow margin, i.e., the pressure ratio across the stagnation point row of film holes, will permit the use of a lower supply pressure (compressor air).

DISCLOSURE OF INVENTION

The object of this invention is to provide an improved cooling of the leading edge of the turbine blade of a gas turbine engine.

A feature of this invention is to angle the impingement hole delivering cool air to impinge on the side inner wall of the airfoil of the turbine blade, and provide an annular projection adjacent and parallel to the impingement hole to feed the impingement cavities with total pressure.

A still further feature is to angle the internal ribs of the leading edge so that all the film holes being fed cooling air from the impingement cavities will be open to a single cavity.

A still further feature of this invention is to align the impingement holes to be in coincidence with the film holes.

The foregoing and other features and advantages of the present invention will become more apparent from the following description and accompanying drawings.

BEST MODE FOR CARRYING OUT THE INVENTION

Figure 1:
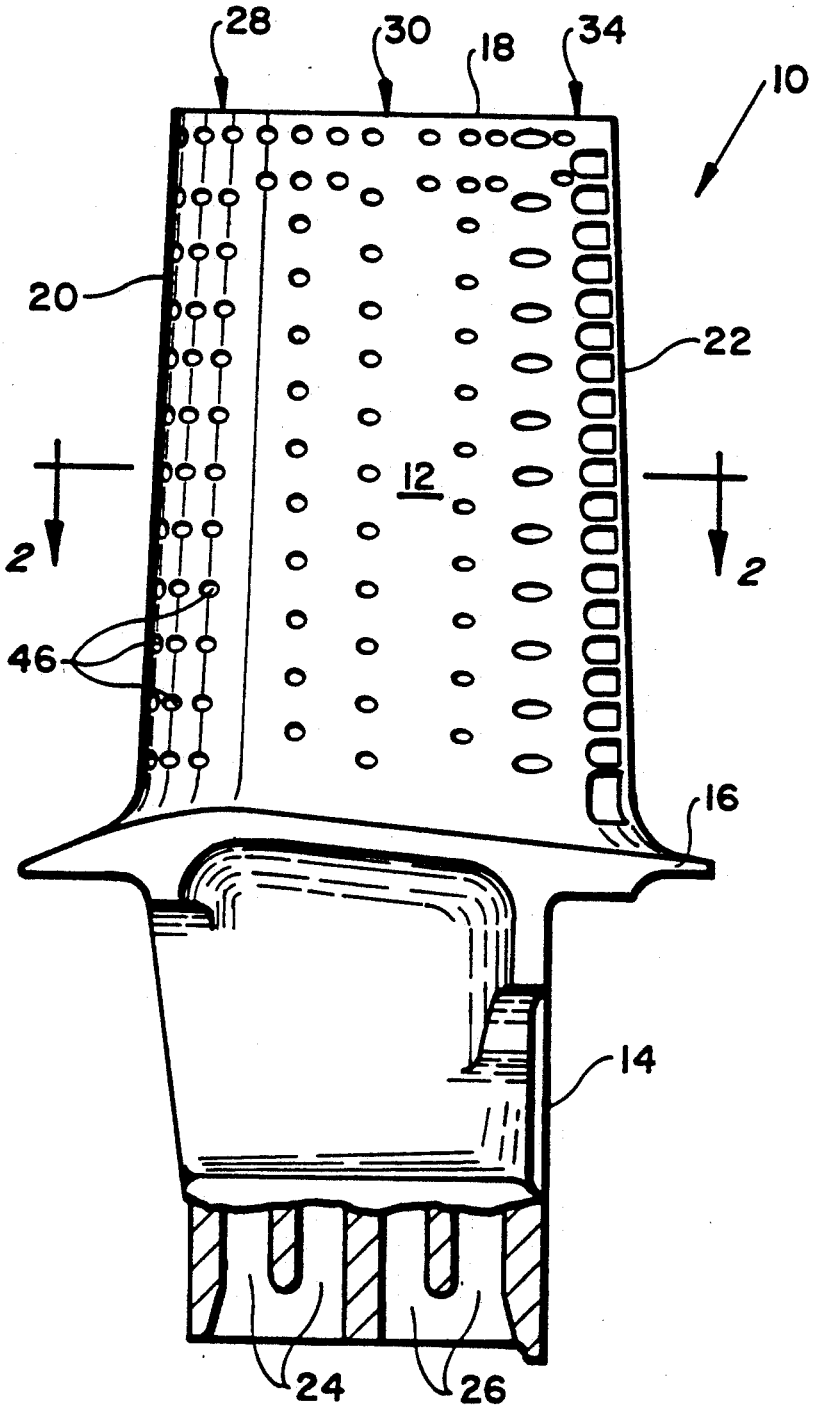
FIG. 1 is a side view in elevation of the pressure side of a cooled turbine blade for a gas turbine engine.
Figure 2:
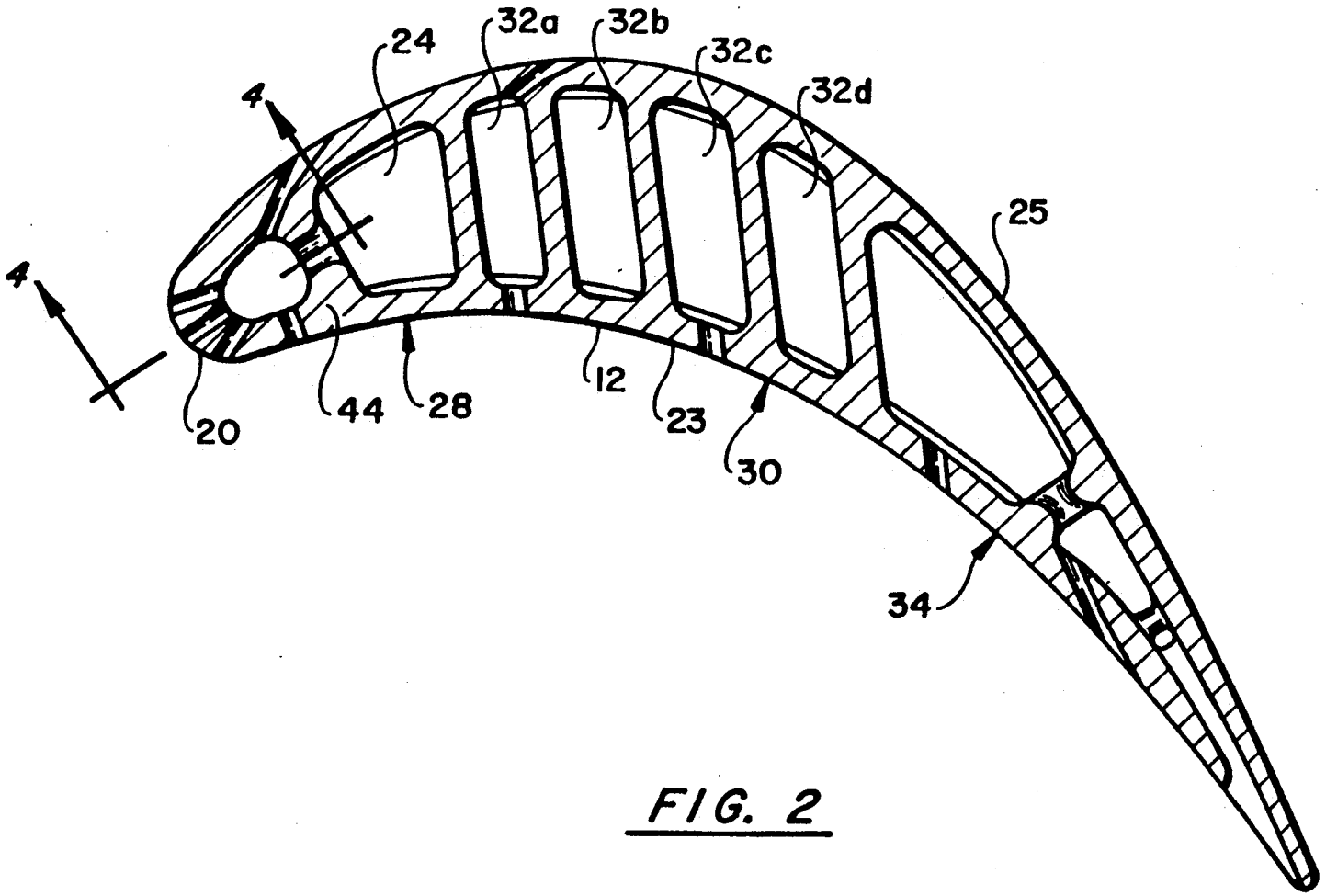
FIG. 2 is a cross sectional view taken along lines 2—2 of FIG. 1.

This invention is best understood by referring to FIGS. 1 to 4 (inclusive). A plurality of turbine blades which are supported to a turbine disk mounted on the engine's shaft serve to extract energy from the engine's working medium to power the gas turbine compressors and engine accessories. A description of one of the blades generally indicated by reference number 10 will, for the sake of convenience and simplicity, describe all the other turbine blades, but for more details of a turbine rotor and gas turbine engine, reference should be made to the F100 family of gas turbine engines manufactured by Pratt & Whitney Division of United Technologies Corporation, the assignee of this patent application and U.S. Pat. No. 4,257,737 granted on Mar. 24, 1981 to D. E. Andress et al and assigned to United Technologies Corporation, the assignee of this patent application Typically, the air cooled blade comprises the airfoil section 12, the root section 14, and the platform 16. The airfoil section is bounded by a tip 18, a leading edge 20, trailing edge 22 pressure surface 23 and suction surface 25. Cooling air from a source, typically one of the compressor stages (not shown), admits compressed air through the root 14 into internal passageways 24 and 26, one serving to supply cooling air to the leading edge portion 28 of the blade, and the other serving to supply cooling air to the mid-portion 30, which consists of an array of serpentine passageways **32*a*, 32*b*, 32*c* and 32*d* and the trailing edge portion 34** of the blade.

As this invention pertains solely to the leading edge portion 28, the remaining description will be directed to this portion, it being understood that the other portions are well known in this art.

Passageway or feed up pass 24 extends radially from the blade's root to just short of the tip 18 and serves to supply the radially spaced chambers or impingement cavities **40*a*, 40*b***, etc. (the number of cavities depend on the particular application). Chambers of this type are enclosed and capture the cooling air and are customary in many of the turbine blade designs.

Figure 3:
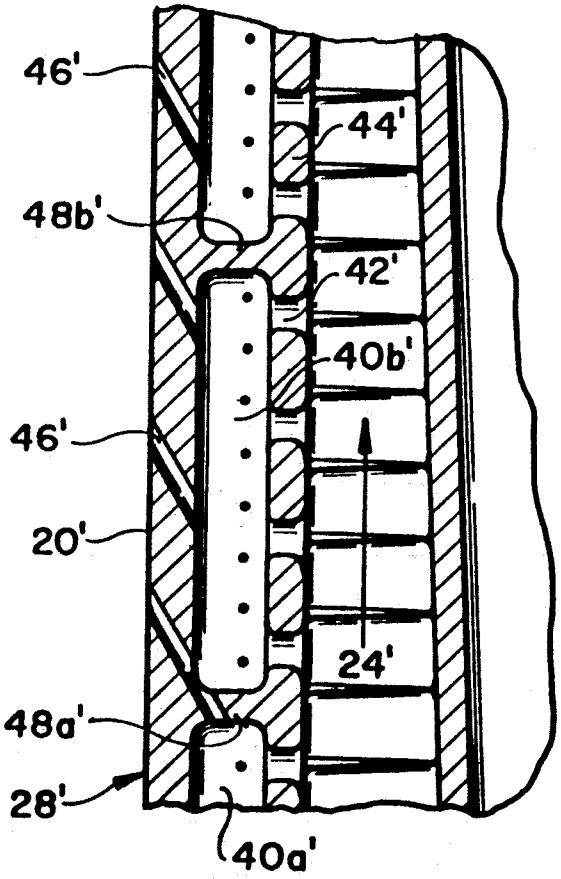
FIG. 3 (PRIOR ART)
FIG. 3 is a partial sectional view of the leading edge cooling portion of a turbine blade exemplifying the prior art design.

The best way to understand this invention is to refer to FIG. 3 which is a prior art configuration. (Like elements in all the FIGS. carry the same reference numerals, although the numerals referencing elements in the prior art blade are designated with a prime mark.) The feed up pass 24' supplies each of the impingement cavities through a plurality of radially spaced holes 42' formed in the internal radial wall 44'. The flow of cooling air impinges on the back surface of the leading edge of the airfoil and serves to cool this material. Additional cooling is attained by flowing air out of the film holes 46' which form a film of cooling air over the exterior surface of the blade exposed to the gas path. The film holes 46' are formed by drilling into the metal wall to penetrate the impingement cavities **40*a'*, 40*b'***, etc. and extend radially from the root to the tip of the blade.

It is apparent from FIG. 3 that some of the drilled holes for the film cooling air will penetrate through one of the ribs **48*a'*, 48*b'***, etc., exposing the film cooling to two adjacent chambers. This results in a local low pressure at the place where the film hole breaks into the corner of the rib.

In the prior art cooling scheme the impingement holes 42' are perpendicular to the wall defining each of the impingement cavities **40*a'*, 40*b'*, etc., and hence relies solely on the static pressure of the cooling air in passage 24'** to feed these cavities.

Figure 4:
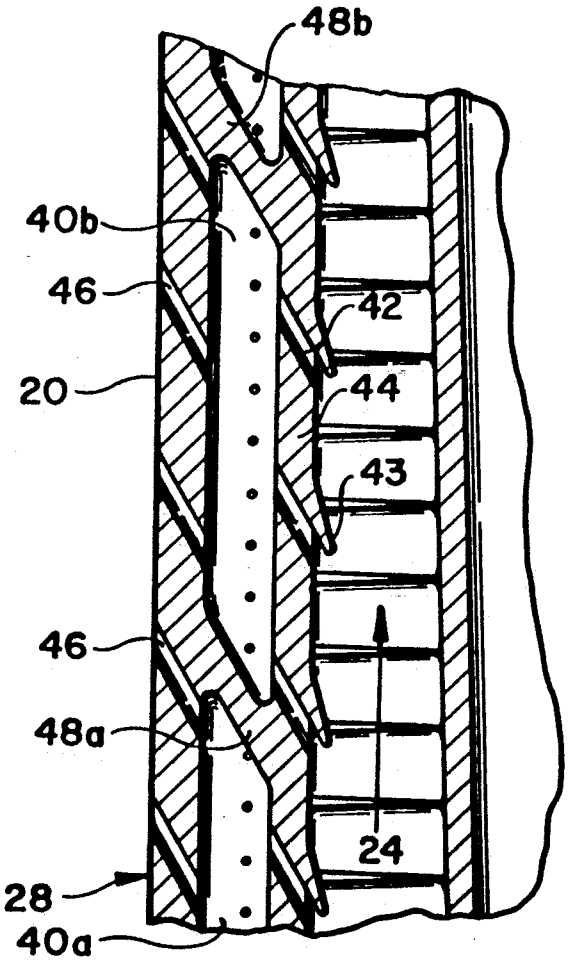
FIG. 4 is a partial sectional view taken along lines 4—4 of FIG. 2, the identical section shown in FIG. 3 if it were a prior art design.

According to this invention and as best shown by referring to FIG. 4, the wall defining the impingement cavity is modified from the structure in FIG. 3 to include a projection 43 that extends angularly in the feed up chamber 24 and serves to turn the air entering the now angularly disposed impingement holes 42. As clearly shown in FIG. 4, the impingement holes 42 in the preferred embodiment are discretely angled and located to align with the film cooling holes 46 wherever the possibility exists. This alignment serves to assure that the film holes 46 will be fed by total pressure and consequently increasing the outflow margin of the film holes.

Also, according to this invention the ribs 48*a*, 48*b*, etc. defining the impingement cavity are also angled. This obviates the problem heretofore encountered of having the film holes intercept the rib's corner and thus assures that the film holes are open solely to a single cavity.

Although the invention has been shown and described with respect to detailed embodiments thereof, it will be understood by those skilled in the art that various changes in form and detail thereof may be made without departing from the spirit and scope of the claimed invention.

We claim:

1. A turbine blade for a gas turbine engine including a leading edge, a trailing edge a root section and a tip section and including internal air cooling passageways and a plurality of longitudinally extending wall adjacent to the leading edge, a longitudinally extending wall adjacent to the leading edge defining said cavities, the improvement comprising angular, longitudinally spaced impingement holes leading cooling air into said cavities a feed passageway extending from the root section to the tip section of the blade for flowing cooling air internally in said blade, and a projection parallel to and adjacent to said impingement hole extending into said feed passageway and said feed passageway being located closer to said leading edge than said trailing edge of said blade whereby the pressure of said cooling air admitted into said cavities from said impingement holes is total pressure.

2. A turbine blade as claimed in claim 1 wherein said impingement holes are aligned with film cooling holes formed in said leading edge.

3. A turbine blade as claimed in claim 2 including transverse ribs between adjacent cavities being angularly disposed parallel to said impingement holes.

* * * * *